US006341689B1

(12) United States Patent
Jones

(10) Patent No.: US 6,341,689 B1
(45) Date of Patent: Jan. 29, 2002

(54) BASKET CARRIER WITH PARTITION PANELS ATTACHED TO END FLAPS

(75) Inventor: Marty Jones, Graham, NC (US)

(73) Assignee: Riverwood International Corporation, Atlanta, GA (US)

( * ) Notice: Subject to any disclaimer, the term of this patent is extended or adjusted under 35 U.S.C. 154(b) by 0 days.

(21) Appl. No.: 09/662,479

(22) Filed: Sep. 15, 2000

(51) Int. Cl.[7] ..... B65D 75/00

(52) U.S. Cl. ..... 206/175; 206/193; 206/427; 294/87.2

(58) Field of Search ..... 206/193, 194, 206/174, 175, 180, 187, 188, 200, 141, 142, 199, 196, 162, 427; 294/87.2

(56) References Cited

U.S. PATENT DOCUMENTS 3,860,113 A * 1/1975 Helms ..... 206/185
3,917,059 A * 11/1975 Wood ..... 206/187
3,917,060 A * 11/1975 Wood ..... 206/187
4,010,847 A * 3/1977 Wood et al. ..... 206/187
4,450,956 A * 5/1984 Wood ..... 206/188
5,538,131 A * 7/1996 Harrelson ..... 206/162
6,230,881 B1 * 5/2001 Gollura ..... 206/175
6,247,585 B1 * 6/2001 Holley, Jr. ..... 206/173

* cited by examiner

*Primary Examiner*—Shian Luong

(57) ABSTRACT

This invention relates to carriers that have partition panels attached to one or both ends of the carrier via an end flap. All of the outside panels of these carriers are folded about lines that are parallel to the longitudinal direction of the gluer on which the carrier is folded and glued. All of these carriers have multi-ply handles in which none of the plies are foldably attached to each other at their top edges. Nicks may be provided between the handle panels and the side and end flaps to hold the carrier in proper position during the folding and gluing operation. This invention also relates to a method of folding and gluing the carriers on a straight-line gluer.

6 Claims, 8 Drawing Sheets

BASKET CARRIER WITH PARTITION PANELS ATTACHED TO END FLAPS

BACKGROUND OF THE INVENTION

1. Field of the Invention

The present invention relates to bottle carriers with full protection for the bottles that have a partition panel attached to an end flap on one or both ends of the carrier. These carriers have been constructed so that they are easy to fold and glue on a straight-line gluer. All of the fold lines for folding outside panels of the carrier are parallel to the longitudinal line of the gluer. Most of these carriers have multi-ply handles that are not foldably attached to each other. The multi-ply handle panels can be temporarily attached to side walls or end flaps by nicks to hold the handle in proper position during the folding and gluing operation.

2. Background of the Invention

Right-angle gluers for the folding and gluing of basket carriers are timed and consequently make it relatively easy to fold and glue the carriers. Straight-line gluers are not so timed, thus it is more difficult to fold and glue a carrier on a straight-line gluer. It would be desirable to develop carriers that easily could be folded and glued on a straight-line gluer. It would be necessary to have the various flaps and panels that are folded and glued arranged so that they simply can be flipped over 180° and then glued to the appropriate panel or flap without undesirable bunching of the paperboard.

SUMMARY OF THE INVENTION

It is an object of this invention to develop a series of carriers to provide full protection for bottles that can be folded and glued on straight-line gluers. This object has been obtained by the development of carriers that either have their partition panels attached to an end flap on one end of the carrier or attached to end flaps on both ends of the carriers. The folding and gluing of the outside panels of these carriers take place along fold lines that are parallel to the longitudinal direction of the gluer. The panels or tabs that are to be glued can simply be flipped 180° on a straight-line gluer and glued to the appropriate panel or flap without bunching of the paperboard. The multi-ply handle panels are easy to manipulate on a straight-line gluer in that they are either not foldably attached to each other or are attached by nicks only. The handle plies can be easily flipped into flat position without bunching of the paperboard. It is not necessary that this operation be timed as in the case of carries that are designed to be run on a right-angle gluer. Nicks between the handle panels and the side and end walls and end flaps can be provided to hold the handle panel in proper position during the gluing and folding operation. These nicks are then broken when the carrier is opened to receive bottles.

These and other objects, features, and advantages of the present invention will become more apparent upon reading the following specification in conjunction with the accompanying drawing figures.

DETAILED DESCRIPTION OF THE PREFERRED EMBODIMENTS

The present invention are basket-style carriers primarily intended for carrying a plurality of bottles. These carriers can be formed from a single piece of foldable material, such as a blank cut out of paperboard. The layout of the blank is basically rectangular, which shape results in economizing the amount of paperboard used. These carriers preferably can be used for carrying from four to six or more bottles.

These carriers are designed to be glued on what is referred to as a straight-line gluer. Consequently, the partition panels forming the various cells of the carrier are attached to an end flap on one end of the carrier or end flaps on both ends. This facilitates the gluing on a straight-line gluer as the blank proceeds down through the gluing section with the transverse axis of the blank being parallel to the direction of travel of the conveyor belt conveying the blank through the gluing sections. In this way, as the blank is glued, various panels of the blank can be simply flipped 180° degrees around the fold line after glue has been applied so that the panels are adhered together. The fold lines are either parallel to or at a 90° angle to the line of travel down the gluing line of the blank.

These carriers have multi-ply handles that are either (i) not foldable attached to one another, or are (ii) attached by nicks only as this facilitates folding the carriers. The top of each handle ply ends in a single ply edge rather than a foldable ply when two plies of a handle are folded upon each other, which results in the bunching of paperboard on a straight-line gluer. Even when two plies of the handle are attached by nicks each ply ends in an edge rather than a fold line.

Several embodiments of this carrier are described infra.

Basket-Style Carrier with Partition Panels Attached to Each End of the Carrier

Figure 1:
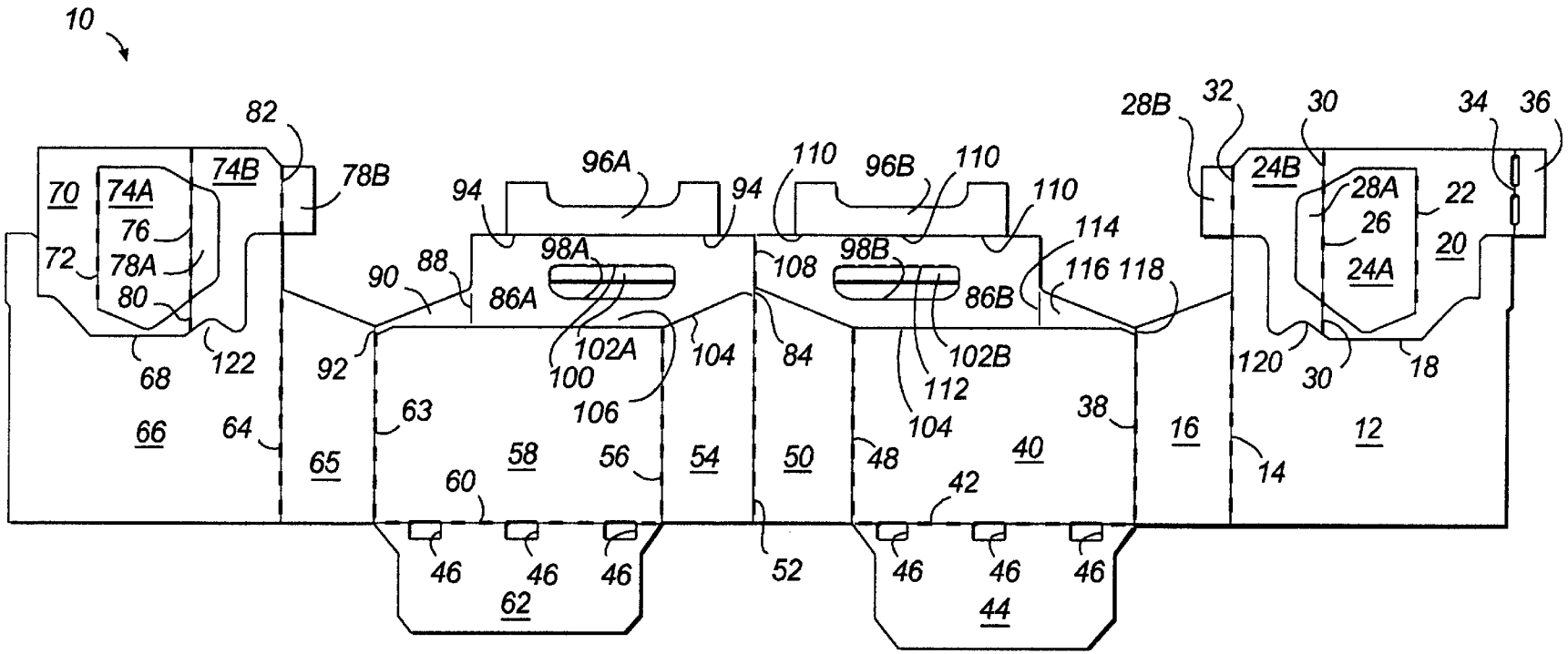
FIG. 1 is a plan view of the blank for forming an embodiment of the carrier of this invention.

FIG. 1 is a plan view of a blank with partition panels attached to each end of the carrier. The blank is illustrated by the numeral 10. The numeral 12 refers to a partition panel which is attached by fold line 14 to end flap 16. Partition panel 12 is attached by fold line 18 to median panel 20. Fold line 18 may be interspersed with cuts to facilitate folding. Median panel 20 is attached by fold line 22 to cell divider 24A, which in turn is attached by fold line 26 to glue tab 28A. Median panel 20 is attached by fold line 30 to cell divider panel 24B, which in turn is attached by fold line 32 to glue tab 28B. Median panel 20 may be attached by fold line 34 to stabilizing flap 36.

End flap 16 is attached by fold line 38 to side wall 40, which in turn is connected by fold line 42 to bottom flap 44. Rectangular apertures 46 may by placed in bottom flap 44 adjacent to fold line 42 to receive a portion of the heel of the bottle which are placed in the carrier. Side wall 40 is attached by fold line 48, to end flap 50, which in turn is attached by fold line 52 to adjacent end flap 54. End flap 54 is attached by fold line 56 to side wall 58, which in turn is attached by fold line 60 to bottom flap 62, which may also have apertures 46 to receive a portion of the heels of the bottles. Side wall 58 is attached by fold line 63 to end flap 65, which in turn is attached by fold line 64 to partition panel 66, which is attached by fold line 68 to median panel 70, which is attached by fold line 72 to cell divider 74A, which is in turn is attached by fold line 76 to glue tab 78A. Median panel 70 is attached by fold line 80 to cell divider 74*b,* which is attached by fold line 82 to glue tab 78B. Median panels 20 and 70 are separated from their respectively partition panels 12 and 66 by cut lines 120 and 122, respectively. End flap 50 is attached at its top end by fold line 84 to handle panel 86A, which in turn is attached by fold line 88, which is attached to handle support panel 90, which in turn is attached by fold line 92 to the upper end of end flap 65. Handle panel 86A is attached by nicks 94 to handle flap 96A resulting in both handle panel 86A and handle flap 96A having an edge rather than a fold line adjacent nicks 94. Handle panel 86A has a hand aperture 98*a* for carrying. Handle panel 86A is attached by fold line 100 to cushioning flap 102A to cushion the hand while the carrier is being carried. Handle panels 86A is suspended between end flaps 50 and 65. Handle panel 86A is separated from end flap 54 and side wall 58 by cut line 104. A nick 106 (i.e., temporary bridge) may be utilized to hold the handle panel 86A in proper alignment with side wall 58 during the folding and gluing operation. The temporary bridge 106 will be destroyed when the carrier has been opened and filled with bottles. This temporary bridge or nick also serves to hold the folded carrier blank flat during shipment from the manufacturing plant to the bottler where the carrier is opened. A corresponding handle panel 86B is attached by fold line 108 to handle panel 86A. Handle panel 86B is attached by nicks 110 to handle flap 96B. Handle flap 86B has hand aperture 98B. A cushioning flap 102B is connected to handle panel 86B by fold line 112. Handle panel 86B is attached by fold line 114 to handle support 116, which in turn is attached by fold line 118 to end flap 16.

This carrier is ideal for folding and gluing on a straight-line gluer in that all of the fold lines 14, 38, 48, 52, 56, 63, 64 for the outside panels are parallel to the longitudinal direction of the gluer and are parallel to each other to facilitate easy folding of the blank into a folded and glued carrier ready for shipment to a bottling plant for opening and filling with the bottles.

Figure 2:
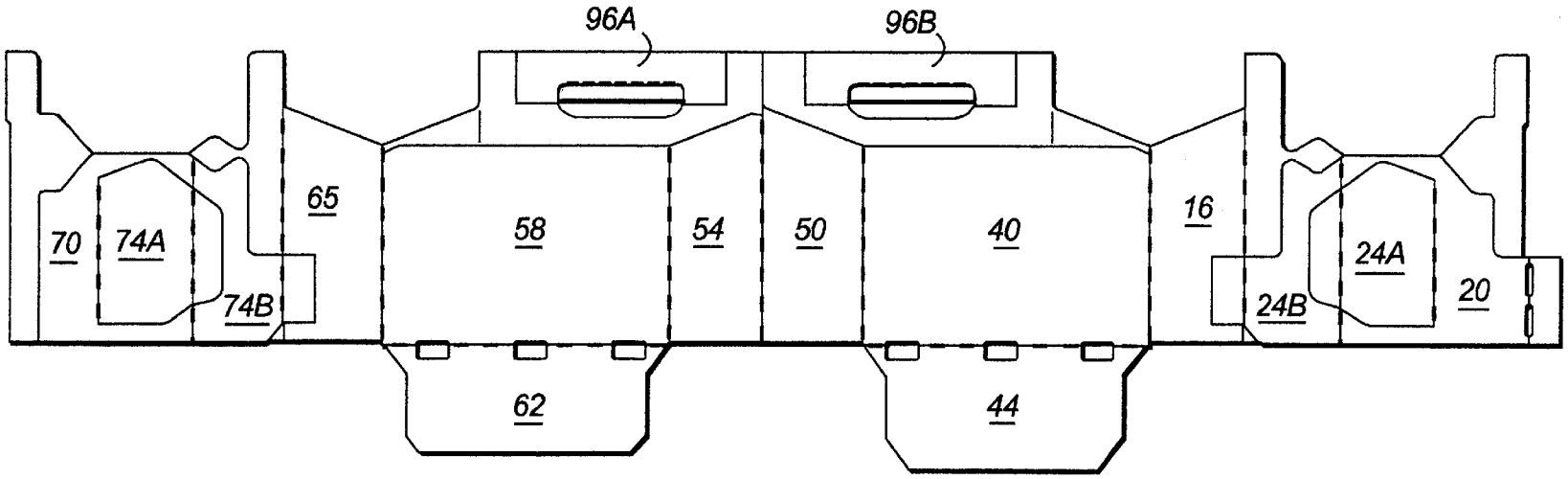
FIG. 2 is a view of the blank of FIG. 1 in which the median panels have been folded onto the partition panel.
Figure 4:
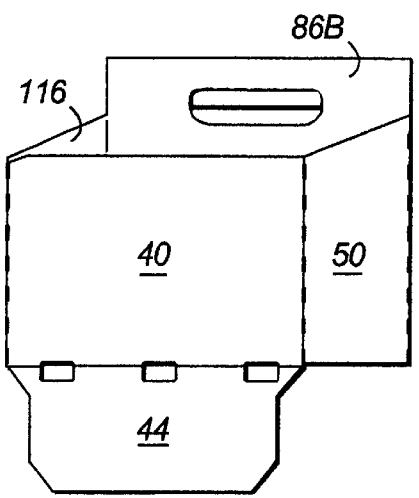
FIG. 4 shows the pre-manufactured carrier in which the partition panels have been glued together.
Figure 3:
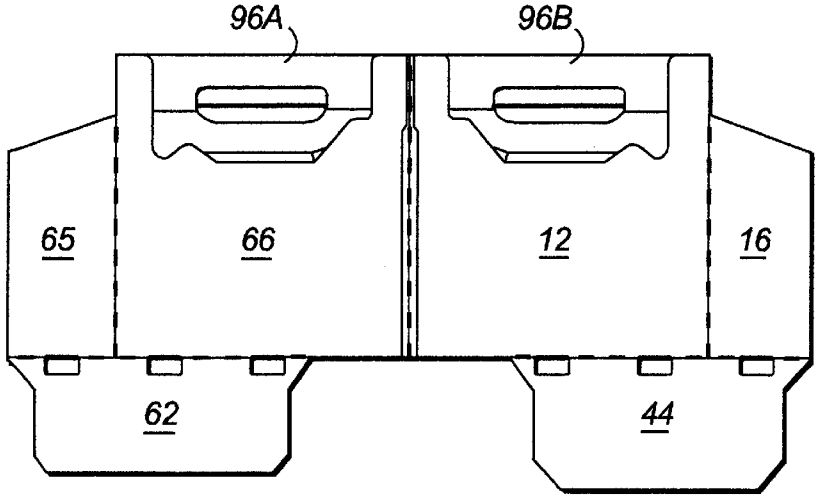
FIG. 3 is a view of the blank of FIG. 1 in which the partition panels have been folded and the glue tabs glued to the side walls.
Figure 5:
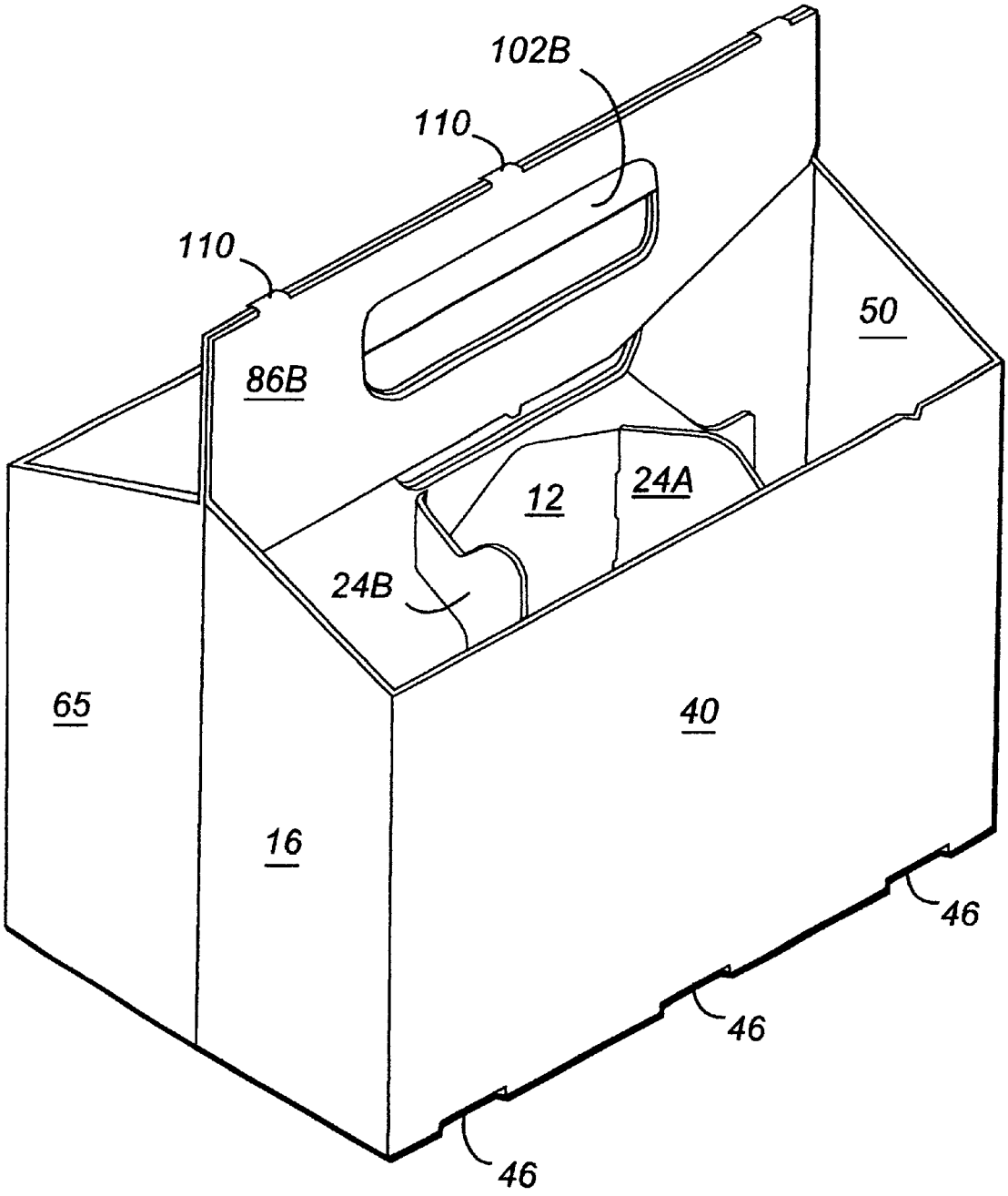
FIG. 5 shows the carrier after it has been opened and is ready to receive bottles.

This carrier is manufactured by folding median panels 20 and 70 along fold lines 18 and 68, as shown in FIG. 2. Partition panels 12 and 66 are then folded along fold lines 38 and 63 respectively and glue tabs 28A, 28B and 78A and 78B glued to side walls 40 and 58 respectively to form the cells for containing the bottles as shown in FIG. 3. As shown on FIG. 4, handle flaps 96A and 96*b* can be folded and glued to handle panels 86A and 86B, respectively. The presence of nicks 94 and 110 between handle panels 86A and 86B and handle flaps 96A and 96*b* respectively makes it easy to flip the handle flaps on the straight-line gluer. The cut lines between nicks 94 and 110 result in the paperboard handle having an edge along most of its length. The paperboard does not bunch between these nicks which would make gluing on a straight-line gluer difficult, if not impossible. The pre-manufactured carrier is then finished by flipping one half of the carrier longitudinally onto the other half and gluing partition panels 12 and 66 together as shown in FIG. 4. Handle flaps 96A and 96*b* are glued together to form a 3 ply handle. Stabilizing flap 36 may be folded around partition panel 12 to provided greater stability to the carrier. The carrier is then ready for shipment to the bottling plant where the carrier is opened on a carrier opening machine and bottom flaps 44 and 62 are glued together and the carrier is ready to be filled with bottles as shown in FIG. 5.

This carrier is unique in that all of the fold lines for forming the outside panels of the carrier are parallel to the longitudinal line of the gluer. The partition panels 12 and 66 are attached to each end of the carrier. Nicks 104 and 106 hold the handle panels 86A and 86*b* in place during folding and gluing. This carrier has been designed so that it can be formed on a straight-line gluer.

Figure 6:
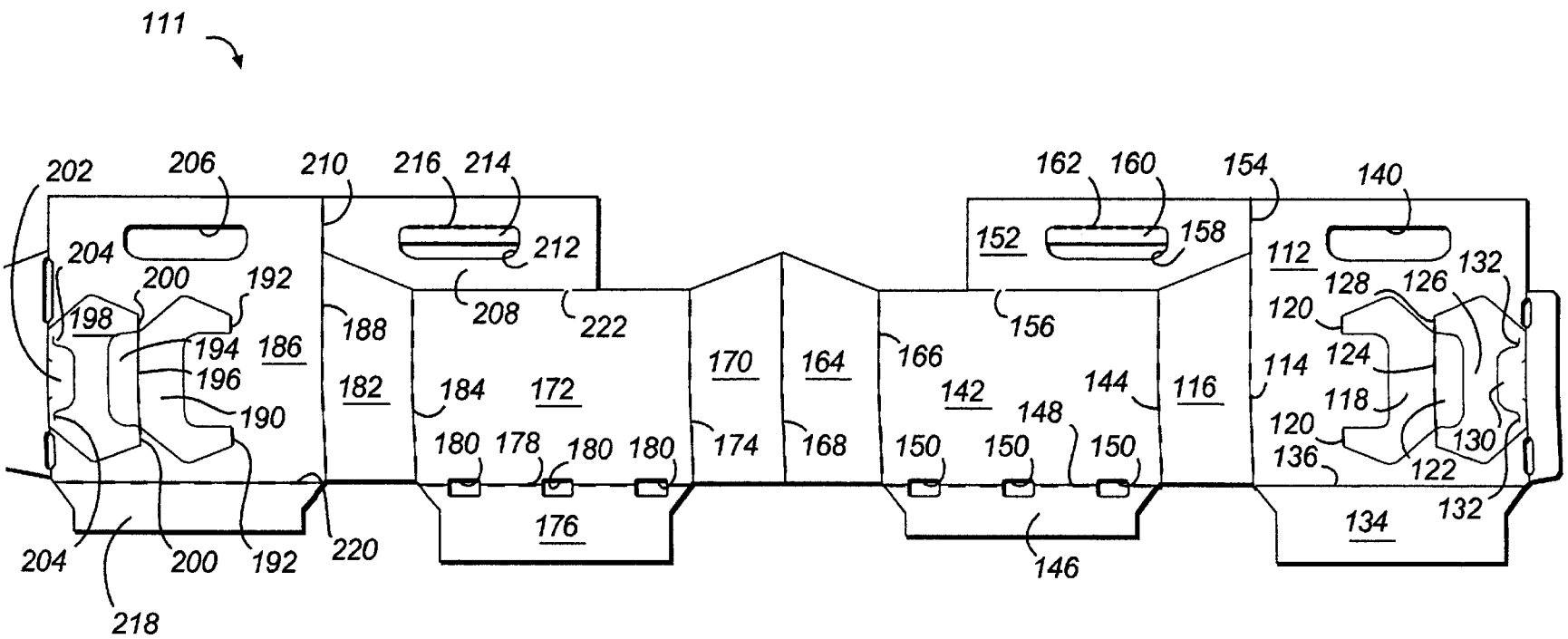
FIG. 6 is the plan view of the blank for forming an embodiment of the carrier of this invention.

Another carrier which has partition panels attached to each end flap is illustrated in FIG. 6. The numeral 111 illustrates a plan view of the blank of this carrier. A partition panel 112 is attached by fold line 114 to end flap 116. Cell divider 118 is struck from partition panel 112 and is attached by fold line 120. A glue flap 122 is attached to cell divider 118 by fold line 124. Cell divider 126 is also struck from partition panel 112 and attached by fold line 128. Glue flap 130 is attached to cell divider 126 by fold lines 132. Bottom glue flap 134 is attached to partition panel 112 by fold line 136. A hand aperture 140 is struck from the top portion of partition panel 112.

Side wall 142 is attached to end flap 116 by fold line 144. Side wall 142 is attached to glue panel 146 by fold line 148. Apertures 150 may be formed within the glue panel to receive a portion of the heels of bottles. A handle panel 152 is attached by fold line 154 to partition panel 112. Handle panel 152 may be attached to end flap 116 and side wall 142 by one or more nicks 156. Handle panel 152 is not attached to partition panel 112*a* its top edge, but rather end at the top edge for ease of folding on a straight-line gluer. Handle panel 152 has a hand aperture 158 and cushioning flaps 160 attached to handle panels by fold lines 162. End flap 164 is attached to side wall 142 by fold line 166 and in turn attached by line 168 to corresponding end flap 170. End flap 170 is attached to side wall 172 by fold line 174. The side wall is in turn attached to bottom glue flap 176 by fold line 178. Bottom glue flap 176 also has apertures 180 for receiving a portion of the heels of bottles. Side wall 172 is attached to end flap 182 by fold line 184. End flap 182 is attached to partition panel 186 by fold line 188. Cell divider 190 is struck from partition panel 186 and attached by fold lines 192 to the partition panel 186. A glue tab 194 is attached to cell divider 190 by fold line 196. Cell divider 198 is struck from partition panel 186 and attached thereto by fold line 200. Glue tab 202 is attached to cell divider 198 by fold lines 204. Hand aperture 206 is struck from the top portion of partition panel 186. Handle panel 208 is attached to partition panel 186 by fold line 210. Handle panel is identical to handle panel 152 in that it ends at its top edge. Hand aperture 212 is struck from handle panel 208. Cushioning flap 214 is attached to handle panel by fold line 216. Handle panel 208 is attached to end flap 182 and side wall 172 by one or more nicks 222. Bottom glue flap 218 is attached to partition panel 186 by fold line 220.

This carrier and the other carriers of this invention are glued on a straight-line gluer in a similar fashion. Consequently, figures showing the stages of manufacture of this and the following carriers are omitted. Reference can be made to FIGS. 2–5 as an aid in visualizing the manufacturing and opening of each carrier.

This carrier is glued on a straight-line gluer by folding partition flaps 112 and gluing glue tabs 122 and 130 to side wall 142. All of the folding is around fold lines parallel to the longitudinal direction of the straight-line gluer. Similarly, partition panel 186 is folded, and glue tabs 194 and 202 are glued to side wall 172. The entire carrier is folded along fold lines 174 and 166 inwardly in the middle along fold line 168 with the backside of partition panel 112 glued to the backside of partition panel 186 to complete the manufacturing of the carton on the gluer. In the process, fold lines 166, 168 and 174 are folded so that end flaps 164 and 170 rest upon each other. This carrier forms a 4 ply handle.

This carrier can be filled with bottles by lowering the carton over six bottles and folding and gluing bottom glue flap 134 to glue panel 146. Bottom glue flap 176 is glued to bottom glue flap 218. It will be understood that the fold lines in this carton may be interspersed with cuts to facilitate folding.

This carrier is unique in that the partition panels 112, 186 are foldably attached to the end flaps 116, 182 at the ends of the carrier. Nicks 156 and 222 hold handle panels 152 and 208 in position during the gluing operation. This carrier has been designed so that it can be glued on a straight-line gluer. All of the folds that are necessary to be made to form and glue this carrier are made along the longitudinal line of the straight-line gluer.

Figure 7:
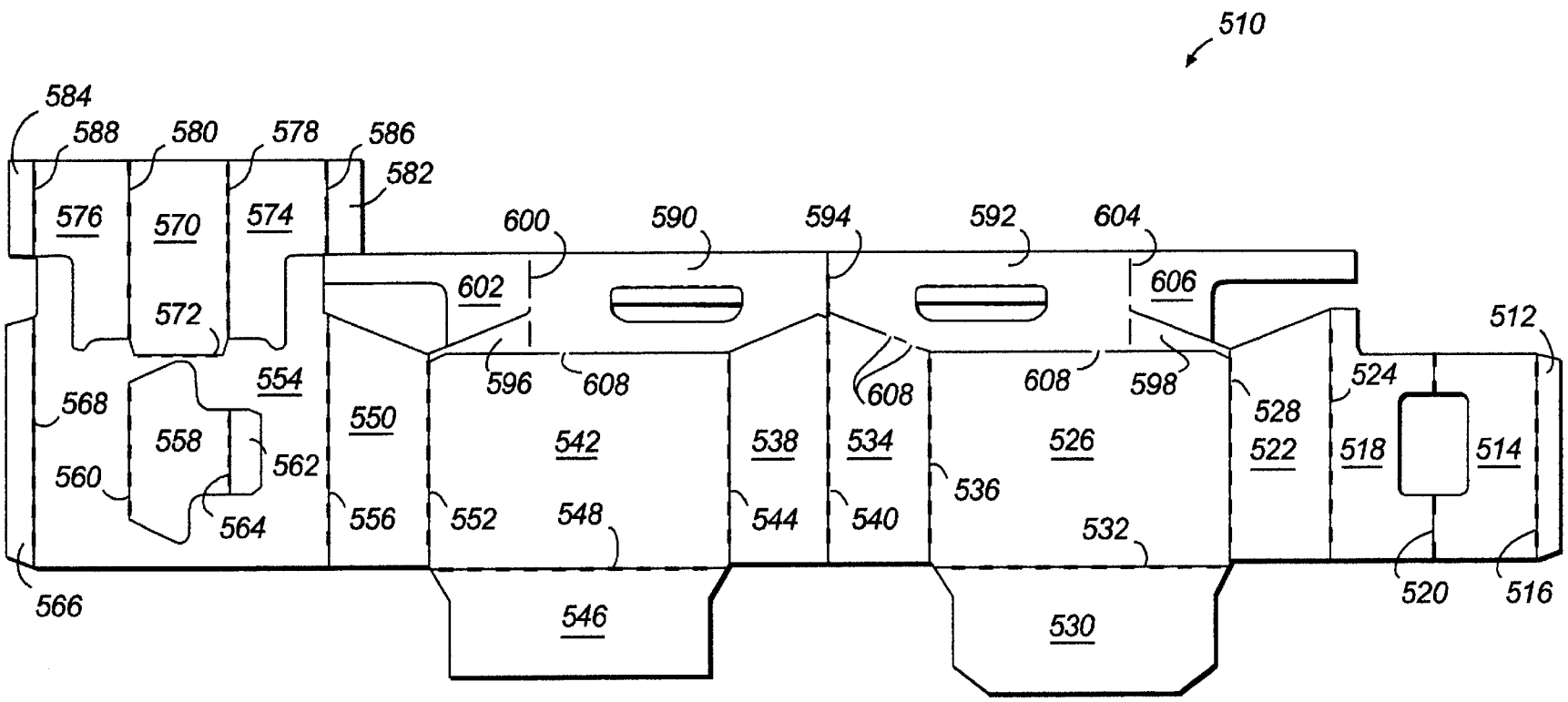
FIG. 7 is the plan view of the blank for forming an embodiment of the carrier of this invention.

Another carrier that has partition panels attached to each end flap, but with somewhat different type of partition panels is illustrated in FIG. 7. The blank is illustrated by the numeral 510. Glue flap 512 is attached to cell divider 514 by fold line 516, which in turn is attached to partition panel 518 by fold line 520. Partition panel 518 is attached to end panel 522 by fold line 524, which in turn is connected to side wall 526 by fold line 528, which in turn is connected to bottom panel 530 by fold line 532. Side wall 526 is attached to end panel 534 by fold line 536, and in turn attached to end panel 538 by fold line 540. End panel 538 is attached to side wall 542 by fold line 544. Side wall 542 is attached to bottom panel 546 by fold line 548. Side wall 542 is attached to end panel 550 by fold line 552. End panel 550 is attached to partition panel 554 by fold line 556. Partition panel 554 is attached to cell divider 558 by fold line 560, and in turn is attached to glue tab 562 by fold line 564. Partition panel 554 is attached to glue flap 566 by fold line 568. Partition panel 564 is attached to median panel 570 by fold line 572. Median panel 570 is attached to cell dividers 574 and 576 by fold line 578 and 580, respectively. Cell dividers 574 and 576 are attached to glue tabs 582 and 584 by fold lines 586 and 588, respectively. Handle panels 590 and 592 are attached together by fold line 594, and in turn are attached to handle support panels 596 and 598, respectively, which in turn are attached to end panels 550 and 522 by fold lines 552 and 528. Handle panel 590 is attached by fold line 600 to handle flap 602, and handle panel 592 is attached by fold line 604 to handle flap 606. Nicks 608 may be provided to attach to handle panels 590 and 592 to the adjoining side walls 542, 526, and end panels 534, 538. The handle panels 590 and 592, and handle flaps 602 and 606 are not attached to each other at their top ends, which facilitates folding the carrier on a straight-line gluer.

This carrier is manufactured by first folding median panel 570 along fold line 572. Handle flap 602 can be folded along fold line 600 and glued to handle panel 590. End panel 522 is folded along fold line 528, and partition panel 518 is folded along fold line 524, and cell divider 514 is folded along fold line 520, and glue flap 512 is folded along fold line 516, and glue flap 512 is glued to side wall 526 to form an end cell for containing a bottle. Handle flap 606 is folded along fold line 604 and glued to handle panel 592. End panel 550, and partition panel 554 are folded along fold line 552, and cell dividers 574 and 576 are folded along fold lines 578 and 580, respectively. Glue flaps 582 and 584 are folded along fold lines 586 and 588 and glued to side wall 542. The carrier is then folded in half along fold line 540 and cell divider 558 is folded along fold line 560, and glue tab 562 is folded along fold line 564 and glued to side wall 526 to finish the manufacture of the folded carrier. The carrier is loaded with bottles in the bottling plant in basically the same manner as the other carriers as described supra.

This carrier is unique in that it has a partition panel attached to one end of the carrier and another type of partition panel attached to the other end of the carrier. The handle panels are held in place by nicks 608 during folding and gluing. With all of the fold lines being parallel to the longitudinal direction of the gluer, the carrier is easy to fold and glue on a straight-line gluer.

Folding Carrier with All Partition Panels Attached to One End of the Carrier

Figure 8:
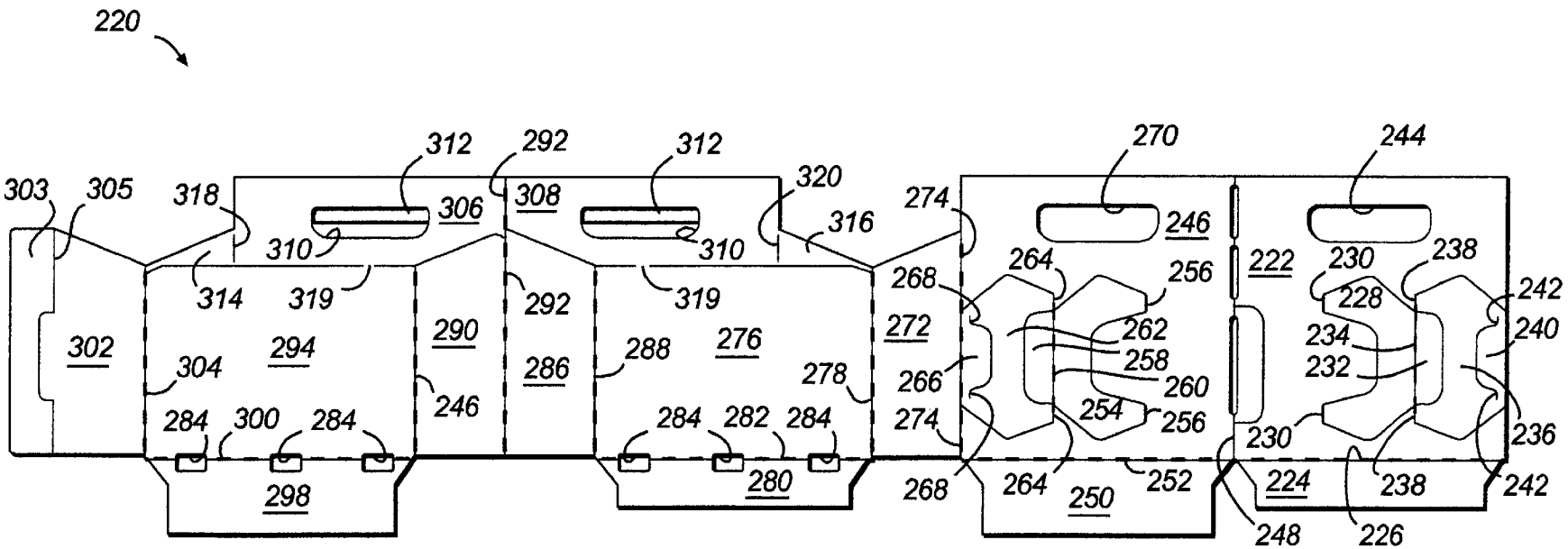
FIG. 8 is the plan view of the blank for forming an embodiment of the carrier of this invention.

Another type of carrier has been developed that can be folded and glued on a straight-line gluer, is one where all of the partition panels are attached to one end of the carrier. One example of such carrier is illustrated in FIG. 8. A plan view of the blank is illustrated by the numeral 220. The partition panel is illustrated by 222, which is attached to bottom glue panel 224 by fold line 226. Cell divider 228 is attached to partition panel 222 by fold lines 230. Glue tab 232 is attached by fold line 234 to cell divider 228. Cell divider 236 is struck from partition panel 222 and attached thereto by fold line 238. Glue tab 240 is attached to cell divider 236 by fold lines 242. A hand aperture 244 is struck from the top end of partition panel 222. Partition panel 222 is attached to a second partition panel 246 by fold line 248. Partition panel 246 is attached to bottom glue flap 250 by fold line 252. Cell divider 254 is struck from partition panel 246 and attached thereto by fold lines 256. Glue tab 258 is attached to cell divider 254 by fold line 260. Cell divider 262 is struck from partition panel 246 and attached thereto by fold lines 264. Glue tab 266 is attached by fold lines 268 to cell divider 262. Hand aperture 270 is struck from the top portion of partition panel 246. Partition panels 222 and 246 are not attached to each other at their tops which facilitates folding on a straight-line gluer. Partition panel 246 is attached to end flap 272 by fold line 274. End flap 272 is attached side wall 276 by fold line 278. Side wall 276 is attached to glue flap 280, which forms part of the bottom of the carrier, by fold line 282. Heel apertures 284 are provided in glue flap 280 to receive a portion of the heels of the bottles.

Side wall 276 is attached to end flap 286 by fold line 288, and in turn is attached to end flap 290 by fold line 292, which in turn is attached to side wall 294 by fold line 296. Side wall 294 is attached to glue flap 298, which also serves as a portion of the bottom of the carrier, by fold line 300. Side wall 294 is attached to end flap 302 by fold line 304. Handle panels 306 and 308 are attached to each other by fold line 292. Both of these handle panels 306 and 308 have hand apertures 310 and cushioning flaps 312. Handle panels 306 and 308 are not attached to each other at their top but rather end in an edge of the paperboard. Handle panels 306 and 308 are respectively attached to handle support panel 314 and 316 by fold lines 318 and 320, respectively. Handle support panel 314 is attached to end flap 302 by fold line 304 and handle support panel 316 is attached to end flap 272 by fold line 278. Glue flap 303 is attached by fold line 305 to end flap 302. Handle panels 306 and 308 are attached to side walls 294 and 276, respectively by nicks 319.

This carrier can easily be folded and glued by folding the carrier at fold line 248. Partition panel 222 can be attached to partition panel 246 by glue in selected areas. The carrier is then folded at fold line 278. Glue tabs 232 and 240 are glued to side wall 276. The carrier is then folded at fold line 292 and glue flap 303 is glued to end flap 272. Glue tabs 258 and 266 are glued to side wall 294 completing the manufacture of the folded carrier.

In the bottling plant, the folded carrier is opened and placed over a grouping of bottles and bottom glue flaps 224, 250, 280 and 298 are glued to form the bottom of the carrier.

This carrier is unique in that the two partition panels 222 and 246 are attached to each other, and in turn are attached to end flap 272. This facilitates the folding and gluing of these carriers on a straight-line gluer. Handle flaps 306 and 308 are held in proper position during the gluing and transportation to the bottle plant by nicks 319.

Figure 9:
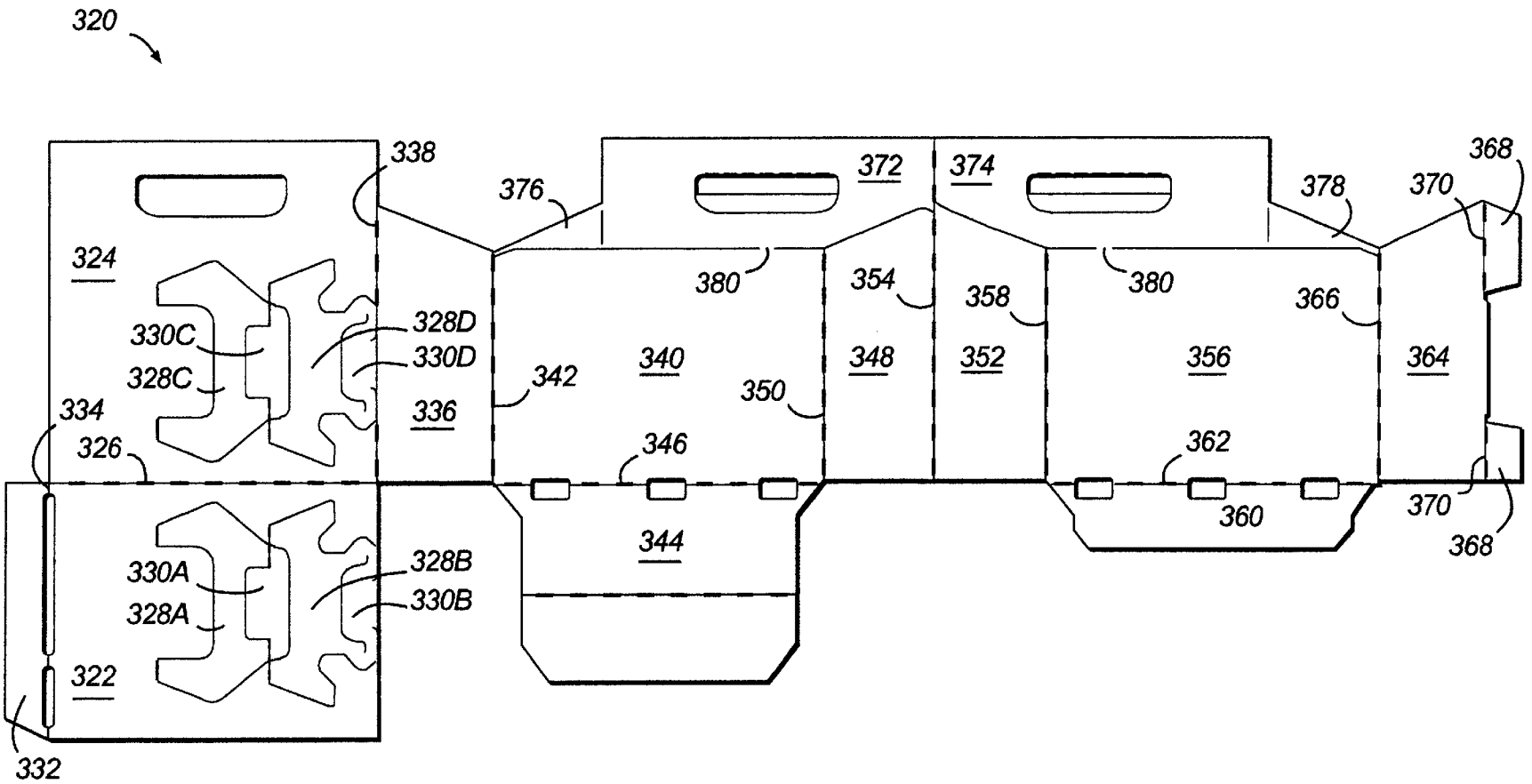
FIG. 9 is the plan view of the blank for forming an embodiment of the carrier of this invention.

Another type of carrier is illustrated by FIG. 9 in which the partition panels are attached to each other at the bottom edges, and one of the panels is attached at one side edge to an end flap. The blank is illustrated by the numeral 320. Partition panel 322 is attached to partition panel 324 by fold line 326 at the respective bottom edge of each partition panel. Cell dividers 328A–D are struck from partition panels 322 and 324. Each is attached to a glue tab 330A–D. Stabilizing panel 332 is attached to partition panel 322 by fold line 334. Partition panel 324 is attached at one of its side edges to end flap 336 by fold line 338. End flap 336 is attached to side wall 340 by fold line 342, which in turn is attached to bottom panel 344 by fold line 346. Side wall 340 is connected to end flap 348 at fold line 350 and in turn is connected to end flap 352 by fold line 354. End flap 352 is connected to side wall 356 by fold line 358. Side wall 356 is connected to glue flap 360 by fold line 362. Side wall 356 is connected to end flap 364 by fold line 366, which in turn is connected to glue flaps 368 by fold lines 370. Handle panels 372 and 374 are attached together by fold line 354 and they are attached to side walls 340 and 356 via handle support panels 376 and 378. Nicks 380 serve to hold handle panels 372 and 374 in proper position during the folding and gluing operations. Handle panels 372 and 374 are not attached to each other at their top edges which facilitates folding this carrier on a straight-line gluer.

In the folding and gluing of this carton into a folded blank, partition panel 322 is folded over and glued to partition panel 324. The carrier is then folded about fold line 342, and glue tabs 330*a* and 330*b* are glued to side wall 340. The carrier is then folded about fold line 354, and glue tabs 330*c* and 330*d* are glued to side wall 356. End flap 364 is then folded, and glue tab 368 is glued to partition panel 324.

This carrier is opened and placed over the bottles, and glue flap 360 is glued to bottom panel 344. The nicks 380 are then broken at the time the handle panels 372 and 374 are brought into the carrying position. The steps in folding and gluing this carrier on a straight-line gluer can be easily accomplished. This carrier also has a strong bottom in that bottom panel 344 extends in a single piece across the bottom of the carrier.

This carrier is unique in that both partition panels are attached at one end of the carrier. The handle panels are held in position during folding and gluing by nicks between the handle panels and the side walls. These features facilitate gluing the carrier on a straight-line gluer.

Figure 10:
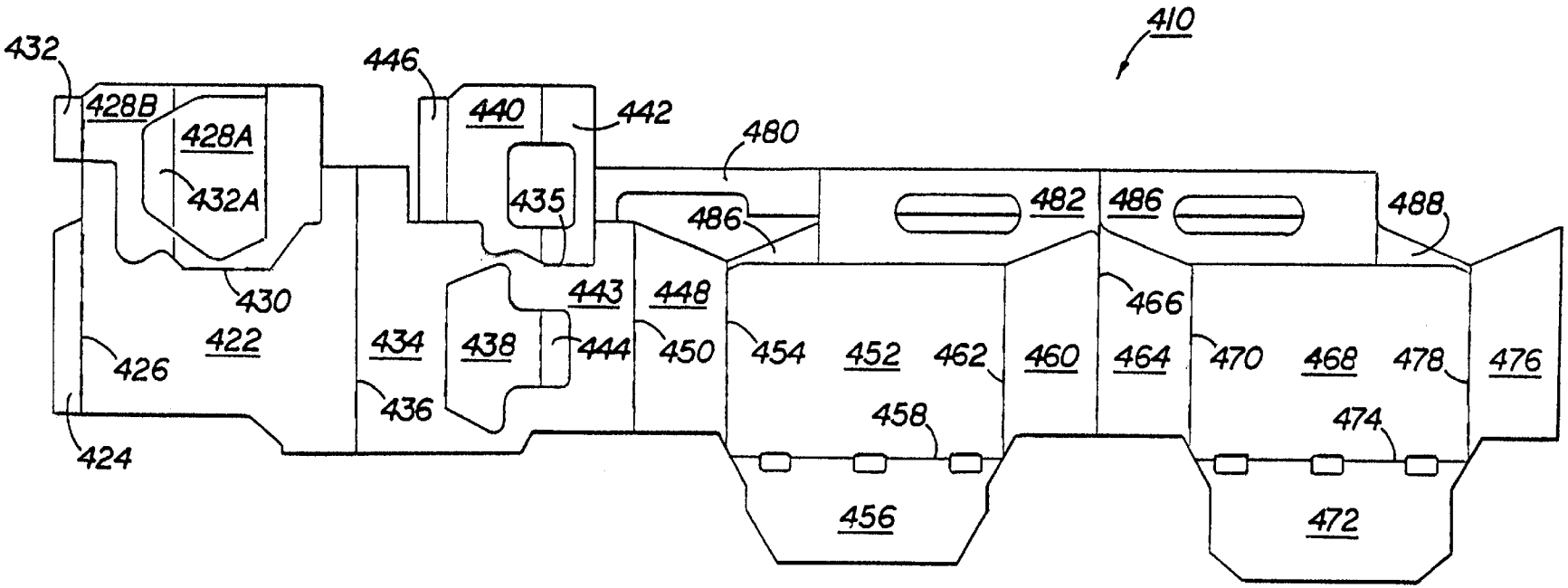
FIG. 10 is the plan view of the blank for forming an embodiment of the carrier of this invention.

A carrier in which a partition panel is attached at its side to the side of a partition panel, which in turn is attached to an end flap is illustrated in FIG. 10. The blank is illustrated by the numeral 410. A partition panel is illustrated by the numeral 422, which is attached to a glue flap 424 by fold line 426. Cell dividers 428A and 428B are foldably attached and struck from partition panel 422 and separated therefrom by fold line 430. Cell dividers 428A and 428B have glue tabs 432A and 432B, respectively. Partition panel 422 is attached to partition panel 434 by fold line 436. Cell dividers 438 and 440 are struck from partition panel 434. Cell divider 440 is foldably attached to partition panel 434 via support panel 442. Cell dividers 438 and 440 have glue tabs 444 and 446. Partition panel 434 is foldably attached to end flap 448 by fold line 450. End flap 448 is foldably attached to side panels 452 by fold line 454. Side panel 452 is foldably attached to bottom panel 456 by fold line 458. Side panel 452 is foldably attached to end flap 460 by fold line 462, and in turn attached to end flap 464 by fold line 466. End flap 464 is foldably attached to side wall 468 by fold line 470. Side wall 468 is attached to bottom panel 472 by fold line 474. Side wall 468 is foldably attached to end flap 476 by fold line 478.

This carrier has a 2½ ply handle composed of a cantilevered handle flap 480, which is foldably attached to handle panel 482, which in turn is foldably attached to handle panel 484, which are attached via support panel 486 and 488 to side walls 452 and 468, respectively. None of the handle panels or flaps are attached to each other at their top ends which permits this carrier to be folded on a straight-line gluer.

This carrier lends itself to being folded and glued on a straight-line gluer in that the first step is folding divider cells 428A and 428B along fold line 430. Divider cell 440 is folded along fold line 435 into proper position. The cantilevered handle flap 480 is folded onto handle panel 482 in the third step. Partition panel 422 is folded along fold line 436, and in turn is folded along fold line 454 onto side wall 452 and 470 and glue tabs 432A, 432B, 444 and 446 glued thereto. The carrier is folded along fold line 466 and end flap 476 glued to end flap 448. This carrier is opened and lowered over bottles in much the same manner as the carrier previously described.

Because partition panels 422 and 434 are attached to end flap 448, this carrier is easy to glue on a straight-line gluer.

While the invention has been disclosed in its preferred forms, it will be apparent to those skilled in the art that many modifications, additions, and deletions can be made therein without departing from the spirit and scope of the invention and its equivalents as set forth in the following claims.

What is claimed is:

1. A bottle basket carrier blank which may be folded and glued on a straight-line gluer into a folded carrier ready for opening and loading with bottles, said carrier having a bottom, side and end walls and two partition panels with cell dividers, with the partition panels being foldably attached to at least one end wall and a multi-ply handle with each ply having an unfolded top edge when the carrier has been folded, the top edge of each of said two handle plies being attached by a plurality of small nicks to a handle flap to facilitate moving the flaps into contact with the two handle plies in a flat relationship with each other and thereby maintain an unfolded top edge.

2. The blank of claim 1 in which one of the end walls is composed of two flaps, one of which is foldably attached to a partition panel which in turn is foldably attached to the second partition panel.

3. The blank of claim 2 in which the side walls have a top edge and at least one of the handle plies has a bottom edge which is attached by small nicks to the top edge of said side wall, said nicks being designed for holding the multi-ply handle in proper position during folding and gluing but being capable of being easily broken when the carrier is opened to receive bottles.

4. The blank of claim 1 in which one of the end walls is composed of two flaps, each of which is foldably attached to a partition panel.

5. The blank of claim 4 in which the side walls have a top edge and at least one of the handle plies has a bottom edge which is attached by small nicks to the top edge of said side wall, said nicks being designed for holding the multi-ply handle in proper position during folding and gluing but being capable of being easily broken when the carrier is opened to receive bottles.

6. The blank of claim 1 in which the side walls have a top edge and at least one of the handle plies has a bottom edge which is attached by small nicks to the top edge of said side wall, said nicks being designed for holding the multi-ply handle in proper position during folding and gluing but being capable of being easily broken when the carrier is opened to receive bottles.

* * * * *